US009368881B2

(12) United States Patent
Lee et al.

(10) Patent No.: US 9,368,881 B2
(45) Date of Patent: Jun. 14, 2016

(54) ANTENNA FOR A RADAR DETECTOR

(75) Inventors: Jeong Hae Lee, Seoul (KR); Min Woo Park, Gyeonggi-do (KR)

(73) Assignee: BG T&A CO., Gyeonggi-Do (KR)

( * ) Notice: Subject to any disclaimer, the term of this patent is extended or adjusted under 35 U.S.C. 154(b) by 273 days.

(21) Appl. No.: 14/342,375

(22) PCT Filed: Nov. 25, 2011

(86) PCT No.: PCT/KR2011/009088

§ 371 (c)(1),
(2), (4) Date: Feb. 28, 2014

(87) PCT Pub. No.: WO2013/032069

PCT Pub. Date: Mar. 7, 2013

(65) Prior Publication Data

US 2014/0218259 A1 Aug. 7, 2014

(30) Foreign Application Priority Data

Aug. 29, 2011 (KR) ..... 10-2011-0086728

(51) Int. Cl.

| | |
|---|---|
| ***H01Q 1/50*** | (2006.01) |
| ***H01Q 21/30*** | (2006.01) |
| ***H01Q 1/32*** | (2006.01) |
| ***H01Q 9/04*** | (2006.01) |
| ***H01Q 21/00*** | (2006.01) |
| ***H01Q 21/06*** | (2006.01) |

(52) U.S. Cl.

CPC ..... *H01Q 21/30* (2013.01); *H01Q 1/3233* (2013.01); *H01Q 9/0428* (2013.01); *H01Q 9/0442* (2013.01); *H01Q 21/0075* (2013.01); *H01Q 21/065* (2013.01)

(58) Field of Classification Search

USPC ..... 343/745, 843, 844, 850, 893

See application file for complete search history.

(56) References Cited

U.S. PATENT DOCUMENTS

| | | | | |
|---|---|---|---|---|
| 5,045,862 | A * | 9/1991 | Alden | H01Q 1/248 343/700 MS |
| 8,063,832 | B1 * | 11/2011 | Weller | H01Q 9/0457 343/700 MS |
| 8,115,683 | B1 * | 2/2012 | Stefanakos | H01Q 1/248 136/255 |
| 2009/0309799 | A1 * | 12/2009 | Hossain | H01Q 3/44 343/754 |
| 2014/0078005 | A1 * | 3/2014 | Park | H01Q 13/08 343/700 MS |

FOREIGN PATENT DOCUMENTS

| | | | |
|---|---|---|---|
| KR | 10-2001-0000213 | A | 1/2001 |
| KR | 10-2009-0057537 | A | 6/2009 |
| KR | 10-2010-0113347 | A | 10/2010 |

* cited by examiner

*Primary Examiner* — Sue A Purvis
*Assistant Examiner* — Jae Kim
(74) *Attorney, Agent, or Firm* — Perkins Coie LLP

(57) ABSTRACT

An antenna for a radar detector according to the present invention comprises: a power supply unit; first and second branches branched from the power supply unit; a first band patch antenna connected to the first branch and having first band properties; a second band patch antenna connected to the second branch and having second band properties; a second band stub placed between the power supply unit and the first band patch antenna on the first branch; and a first band stub placed between the power supply unit and the second band patch antenna on the second branch. The antenna for the radar detector according to the present invention may match one power supply unit without damaging the properties of a plurality of antennas that have different frequency properties.

16 Claims, 20 Drawing Sheets

ANTENNA FOR A RADAR DETECTOR

TECHNICAL FIELD

The present invention relates to an antenna for a radar detector, and more particularly, to an antenna for a radar detector including a plurality of patch array antennas having different operational frequencies.

BACKGROUND ART

A radar detector is equipment that detects a laser or a microwave emitted from a speed gun used for measuring a speed of a vehicle and the like, a safety alarm device informing road information, or the like, and a use of the radar detector is legally recognized in some countries.

In the United States, the speed gun is defined to use a frequency range of an X band of 8 GHz to 12 GHz, a Ku band of 10.95 GHz to 14.5 GHz, a K band of 18 GHz to 27 GHz, a Ka band of 26.5 GHz to 40 GHz.

The speed gun uses various types using various frequencies, but since an antenna used in the radar detector is designed to respond to a specific frequency band, the antenna does not correspond to a speed gun using a frequency band other than the corresponding frequency band.

In order to detect various frequencies, when a plurality of antennas responding to different frequency bands is embedded, the size of the radar detector is increased, and the number of power supply units required for each antenna is increased, and thus the entire circuit is complicated.

Further, in the case of a radar detector used in a high frequency, since a high gain and a large bandwidth are required, a horn antenna has been used. However, the horn antenna has a limit to minimizing the radar detector due to a structural limitation.

In order to reduce in size and thickness of the radar detector, a microstrip patch antenna may be used, but the microstrip patch antenna has advantages of being manufactured in a small size and a small thickness, but disadvantages of a low gain and a small bandwidth.

DISCLOSURE

Technical Problem

In order to solve the above-mentioned problems, an aspect of the present invention provides an antenna for a radar detector capable of matching a plurality of antennas having different operational frequencies with one power supply unit.

Another aspect of the present invention provides an antenna for a radar detector having a larger bandwidth and a wide gain.

Technical Solution

In accordance with an embodiment of the present invention, an antenna for a radar detector) includes: a power supply unit; first and second branches branched from the power supply unit; a first band patch antenna connected to the first branch and having first band properties; a second band patch antenna connected to the second branch and having second band properties; a second band stub placed between the power supply unit and the first band patch antenna on the first branch; and a first band stub placed between the power supply unit and the second band patch antenna on the second branch.

In accordance with another embodiment of the present invention, an antenna for a radar detector includes: a power supply unit; a first branch, a second branch, and a third branch branched from the power supply unit; a first band patch antenna connected to the first branch and having a first band property; a second band patch antenna connected to the second branch and having a second band property; a third band patch antenna connected to the third branch and having a third band property; a second band first stub and a third band first stub placed between the power supply unit and the first band patch antenna on the first branch; a first band first stub and a third band second stub placed between the power supply unit and the second band patch antenna on the second branch; and a first band second stub and a second band second stub placed between the power supply unit and the third band patch antenna on the third branch.

Advantageous Effects

The antenna for the radar detector according to the present invention may match one power supply unit without damaging the properties of a plurality of antennas that have different frequency properties, and as a result, one radar detector may correspond to various kinds of speed guns using different frequency bands, and a circuit configuration may be simplified.

Further, the antenna for the radar detector according to the present invention has advantages of providing a large bandwidth and a high gain and easily designing an antenna having a large bandwidth.

The objects of the present invention are not limited to the aforementioned technical objects, and other technical objects, which are not mentioned above, will be apparent to those skilled in the art from the following description.

BEST MODE FOR INVENTION

Figure 1:
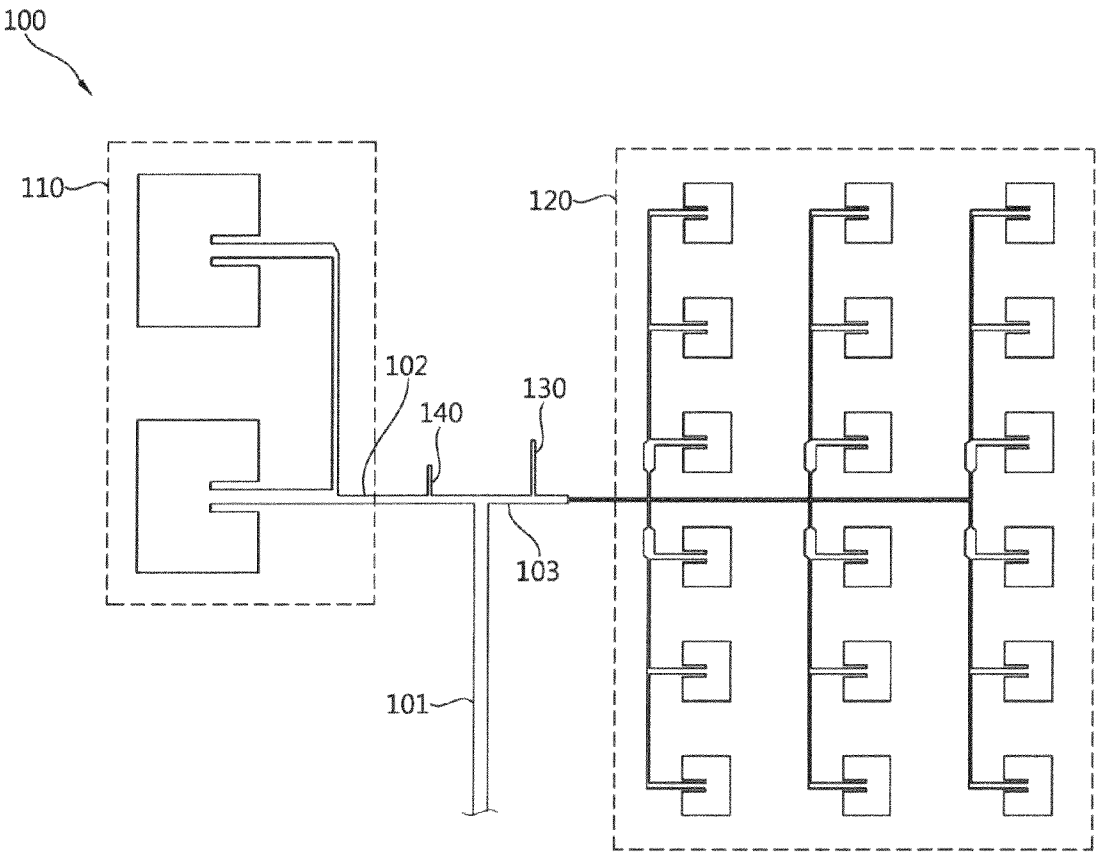
FIG. 1 is a plan view illustrating an antenna for a radar detector according to a first embodiment of the present invention.

Hereinafter, exemplary embodiments of the present invention will be described in detail with reference to the accompanying drawings. However, the present invention is not limited to embodiments to be disclosed below, but various forms different from each other may be implemented. However, the embodiments are provided to be completely known to those skilled in the art. Shapes of elements in the drawings may be enlarged for a more definite description and like elements refer to like elements in the drawings.

FIG. 1 is a plan view illustrating an antenna for a radar detector according to a first embodiment of the present invention.

As illustrated in FIG. 1, an antenna for a radar detector 100 according to a first embodiment of the present invention includes a power supply unit 101 to which a detecting target signal is applied, a first branch 102 and a second branch 103 branched from the power supply unit 101, a first band patch antenna 110 connected to the first branch 102, and a second band patch antenna 120 connected to the second branch 103, a second band stub placed on the first branch, and a first band stub 130 placed on the second branch.

Figure 2:
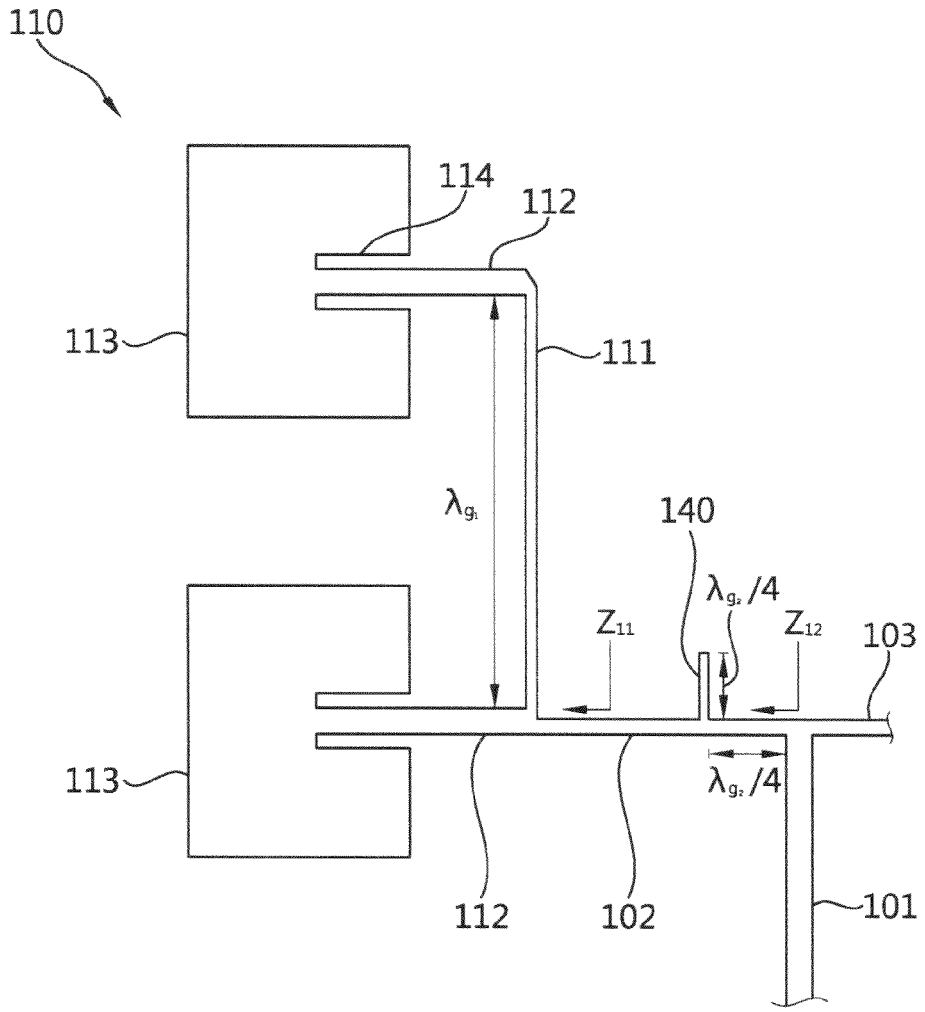
FIG. 2 is a diagram illustrating a first band patch antenna of the antenna for the radar detector according to the first embodiment of the present invention.

FIG. 2 is a diagram illustrating a first band patch antenna of the antenna for the radar detector according to the first embodiment of the present invention. The patch antenna may be formed on a dielectric substrate (not illustrated) having a predetermined thickness, and may be formed on the substrate by using a metal foil such as copper (Cu) or aluminum (Al) or formed on the substrate by using a metal foil such as silver (Ag) or gold (Au) having excellent electric conductivity and good formability and processability.

As illustrated in FIG. 2, the first band patch antenna 110 may include a first band strip 111 connected with the first branch 102, a plurality of first radiation patches 113, and a plurality of first band power supply lines 112 connecting the first band strip 111 and the first radiation patches 113, respectively. The first band strip 111, the first radiation patch 113 and the first branch 102 may be made of the same material as the first band patch antenna 110.

Meanwhile, the first band strip 111 may be substantially vertically connected to an end of the first branch 102, and the first band power supply line 112 may be substantially vertically connected to both ends of the first band strip 111. In addition, the first band power supply line 112 is connected to one side of the first radiation patch 113, and thus the plurality of first radiation patches 113 may be connected to each other in parallel.

An inset 114 recessed to the inside of the first radiation patch 113 may be included at a portion where the first radiation patches 113 and the first band power supply line 112 are connected with each other. A pair of insets 114 may be included at both sides of the first band power supply line 112. Impedance of the first radiation patch 113 may be controlled according to a width of the radiation patch and a length of the inset 114.

First, impedance $R_{patch}$ the radiation patch without the inset is as the following of Equation 1.

$$R_{patch} = \frac{1}{2(G_1 \pm G_{12})};\ y_0 = 0 \qquad \text{[Equation 1]}$$

$G_1$ means conductance of a single slot, and $G_{12}$ means transconductance between slots. $G_1$ and $G_{12}$ are as the following Equations 2 and 3.

$$G_1 = \frac{1}{120\pi^2}\int_0^{\pi}\left[\frac{\sin\left(\frac{k_0 W}{2}\cos\theta\right)}{\cos\theta}\right]^2 \sin^3\theta\, d\theta \qquad \text{[Equation 2]}$$

$$G_{12} = \frac{1}{120\pi^2}\int_0^{\pi}\left[\frac{\sin\left(\frac{k_0 W}{2}\cos\theta\right)}{\cos\theta}\right]^2 J_0(k_0\sin\theta)\sin^3\theta\, d\theta \qquad \text{[Equation 3]}$$

Meanwhile, when the length of the inset is $y_0$, impedance $R_{in}$ of the radiation patch with the inset is as the following Equation 4.

$$\begin{aligned} R_{in} &= \frac{1}{2(G_1 \pm G_{12})}\cos^2\left(\frac{\pi}{L}y_0\right) \\ &= R_{patch}(y_0 = 0)\cos^2\left(\frac{\pi}{L}y_0\right) \end{aligned} \qquad \text{[Equation 4]}$$

As known in Equation 4, the radiation patch has the same width W and length L, the impedance $R_{in}$) varies according to the length $y_0$ of the inset formed at the radiation patch.

In the embodiment, the impedance of the first radiation patch 113 is designed as 200Ω. Since two first radiation patches 112 of which the impedance is designed as 200Ω are connected to each other in parallel, input impedance $Z_{11}$ of the first band patch antenna 110 viewed from the first branch 102 may be 100Ω.

A first band in which the first band patch antenna 110 operates may be an X bandwidth of 8 GHz to 12 GHz. A shape of the first band patch antenna 110 illustrated in FIG. 2 is just one embodiment, and may be designed as a patch antenna operating in any one of different frequency bands, for example, a Ku band of 10.95 GHz to 14.5 GHz, a k band of 18 GHz to 27 GHz, and a Ka band of 26.5 GHz to 40 GHz, and an array shape may be also designed by a different array other than 1×2 array.

Meanwhile, in order to set a phase difference between the first radiation patches 113 as zero, the length of the first band strip 111 may be a positive integer multiple of a guided wavelength $\lambda g_1$ of a first band central frequency. In the embodiment, the length of the first band strip 111 is designed to be substantially the same as the guided wavelength $\lambda g_1$.

Meanwhile, a second band stub 140 may be placed on the first branch 102 between the first band patch antenna 110 and the power supply unit 101.

The second band stub 140 may be formed at a position spaced apart from the power supply unit 101 by ¼ length of a guided wavelength $\lambda g_2$ of a second band central frequency in which the second band patch antenna 120 to be described below operates.

Further, the second band stub 140 may be formed to protrude substantially vertically to the first branch 102 by the ¼ length of the guided wavelength $\lambda g_2$ of the second band central frequency.

For example, when the second band is the K band of 18 GHz to 27 GHz, the second band stub 140 may be formed to protrude by about 2 mm at a position spaced apart from the power supply unit 101.

Meanwhile, in a frequency of the first bandwidth in which the first band patch antenna 110 operates, input impedance $Z_{12}$ of the first band patch antenna 110 including the second band stub 140 is half by the second band stub 140 to become 50 Ω.

Figure 3:
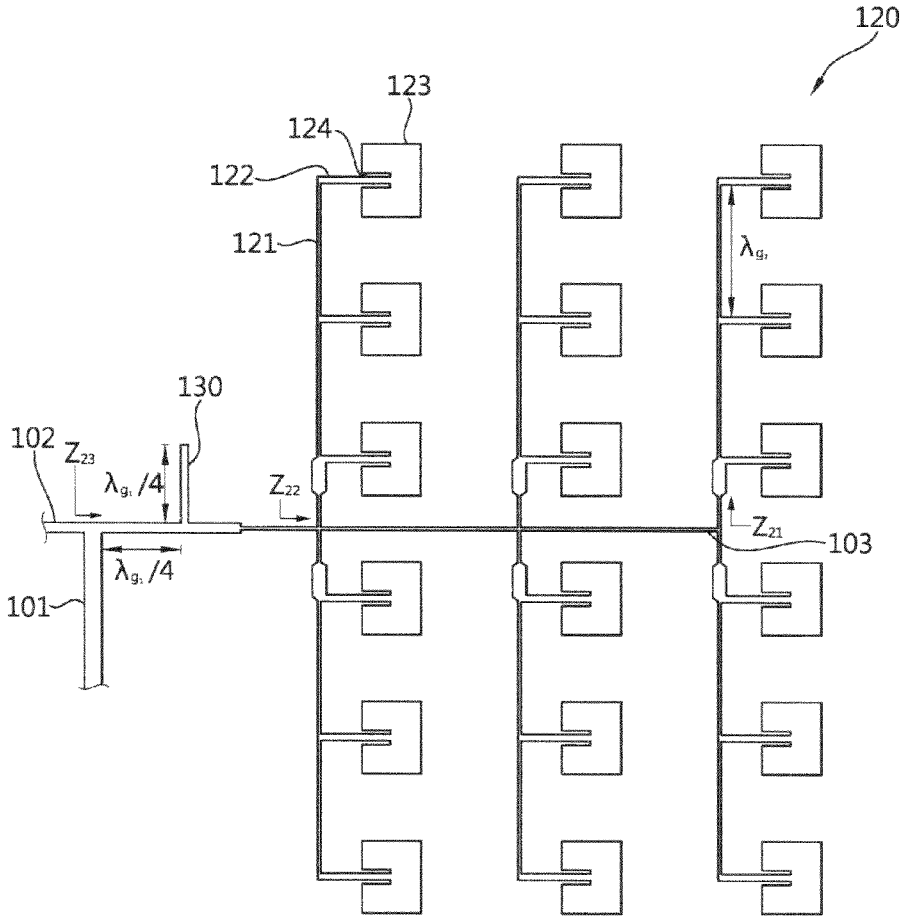
FIG. 3 is a diagram illustrating a second band patch antenna of the antenna for the radar detector according to the first embodiment of the present invention.

FIG. 3 is a diagram illustrating a second band patch antenna of the antenna for the radar detector according to the first embodiment of the present invention.

As illustrated in FIG. 3, the second band patch antenna 120 may include a plurality of second band strips 121 branched from the second branch 103, a plurality of second radiation patches 123, and a second band power supply line 122 connecting the second band strips 121 and the second radiation patches 123, respectively. The second band strip 121, the second radiation patch 123, the second band strip 121, and the second branch 103 may be made of the same material as the second band patch antenna 120.

Meanwhile, the plurality of second band strips 121 may be substantially vertically branched from the second branch 103. In the second band patch antenna 120 illustrated in FIG. 3, since the plurality of second radiation patches 123 is provided with 3×6 array, six second band strips 121 may be symmetrically branched from the second branch 103. The branched shape of the second strips 121 may be various according to the array of the second radiation patch 123.

The second band power supply line 122 may be substantially vertically connected to the second band strip 121. For example, as illustrated in FIG. 3, three second band power supply lines 122 may be included in one second band strip 121.

In addition, the second band power supply line 122 is connected to one side of the second radiation patch 123, and thus the plurality of second radiation patches 123 may be connected to each other in parallel.

An inset 124 recessed to the inside of the second radiation patch 123 may be included at a portion where the second radiation patches 123 and the second band power supply line 122 are connected with each other. A pair of insets 124 may be included at both sides of the second band power supply line 122. An impedance of the second radiation patch 123 may be controlled according to a width of the radiation patch and a length of the inset 124.

The second radiation patches 123 may be formed with the same shape and material to have the same impedance, and in order to set the phase difference between the second radiation patches 123 as zero, the second band power supply lines 122 connected to the same second band strip 121 may be positioned so that an interval therebetween is a positive integer multiple of the guided wavelength $\lambda g_2$ of the second band central frequency. In the embodiment, the interval between the second band strips 122 is designed to be substantially the same as the guided wavelength $\lambda g_2$.

The input impedances $Z_{21}$ viewing each second band strip 121 in the second branch 103 may be substantially the same as each other. In the case of the embodiment, for convenience of the design, the input impedance $Z_{21}$ viewing each second band strip 121 from the second branch 103 is 300Ω.

In addition, input impedance $Z_{22}$ of the second band patch antenna 120 viewed from the second branch 103 before the second band strip 121 is branched is 100Ω.

A second band in which the second band patch antenna 120 operates may be a K band of 18 GHz to 27 GHz. A shape of the second band patch antenna 120 illustrated in FIG. 3 is just one embodiment, and may be designed as a patch antenna operating in any one of different frequency bands, for example, a Ku band of 10.95 GHz to 14.5 GHz, a k band of 18 GHz to 27 GHz, and a Ka band of 26.5 GHz to 40 GHz, and an array shape may be also designed by a different array other than 3×6 array. However, in the second band in which the second band patch antenna 120 operates, a different frequency area from the first band in which the first band patch antenna 110 operates may be selected.

Meanwhile, a first band stub 130 may be placed on the second branch 103 between the first band patch antenna 120 and the power supply unit 101.

The first band stub 130 may be formed at a position spaced apart from the power supply unit 101 by ¼ length of a guided wavelength $\lambda g_1$ of a first band central frequency in which the first band patch antenna 110 operates.

Further, the first band stub 130 may be formed to protrude substantially vertically to the first branch 102 by the ¼ length of the guided wavelength $\lambda g_1$ of the first band central frequency.

For example, when the first band is the X band of 8 GHz to 12 GHz, the first band stub 130 may be formed to protrude by about 4.7 mm at a position spaced apart from the power supply unit 101.

Meanwhile, in the frequency of the second band in which the second band patch antenna 120 operates, input impedance $Z_{23}$ of the second band patch antenna 120 including the first band stub 130 is a half by the first band stub 130 to become 50Ω.

Figure 4:
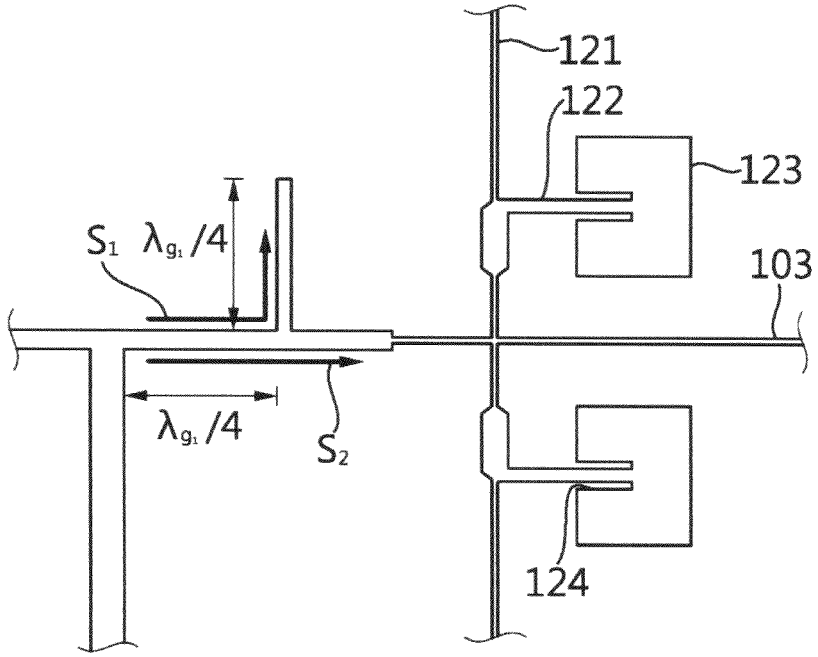
FIG. 4 is a diagram illustrating a progress of a first band signal and a second band signal by a first band stub of the antenna for the radar detector according to the first embodiment of the present invention.

FIG. 4 is a diagram illustrating a progress of a first band signal and a second band signal by a first band stub of the antenna for the radar detector according to the first embodiment of the present invention.

When a signal $S_2$ of the second band is applied to the power supply unit 101, an effect is shown, which is similar to a case in which a circuit is opened at an end of the first band stub 130, and as an effect equivalent to a case in which the circuit is shorted at a point separated from the end of the first band stub 130 by ¼ length of the guided wavelength $\lambda g_1$ of the first band central frequency, that is, a portion where the first band stub 130 is connected with the second branch 103, and as a result, the signal $S_2$ of the second band flows to the second band patch antenna 120.

However, when a signal $S_1$ of the first band is applied to the power supply unit 101, an effect is shown, which is similar to a case in which the circuit is opened at the end of the first band stub 130, and the circuit is opened at a point separated from the end of the first band stub 130 by ½ length of the guided wavelength $\lambda g_1$ of the first band central frequency, that is, a portion where the second branch 103 is branched from the power supply unit 101, and as a result, the signal $S_1$ of the first band does not flow to the second band patch antenna 120.

Figure 5:
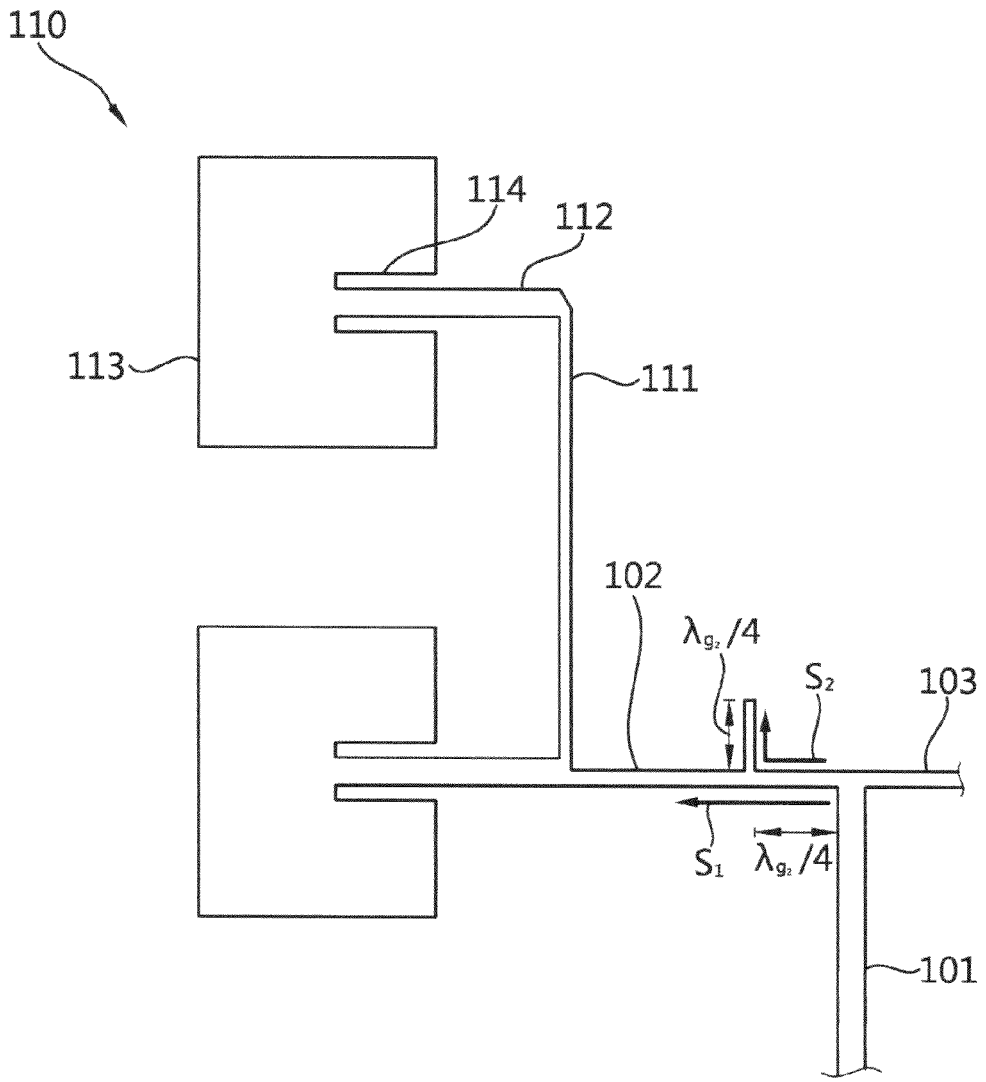
FIG. 5 is a diagram illustrating a progress of a first band signal and a second band signal by a second band stub of the antenna for the radar detector according to the first embodiment of the present invention.

FIG. 5 is a diagram illustrating a progress of a first band signal and a second band signal by a second band stub of the antenna for the radar detector according to the first embodiment of the present invention.

When a signal $S_1$ of the first band is applied to the power supply unit 101, an effect is shown, which is similar to a case in which a circuit is opened at an end of the second band stub 140, and the circuit is shorted at a point separated from the end of the second band stub 140 by ¼ length of the guided wavelength $\lambda g_2$ of the second band central frequency, that is, a portion where the second band stub 140 is connected with first branch 102, and as a result, the signal $S_1$ of the first band flows to the first band patch antenna 110.

However, when a signal $S_2$ of the second band is applied to the power supply unit 101, an effect is shown, which is similar to a case in which the circuit is opened at the end of the second band stub 140, and the circuit is opened at a point separated from the end of the second band stub 140 by ½ length of the guided wavelength $\lambda g_2$ of the second band central frequency, that is, a portion where the first branch 102 is branched from the power supply unit 101, and as a result, the signal $S_2$ of the second band does not progress to the first band patch antenna 110.

Figure 6A:
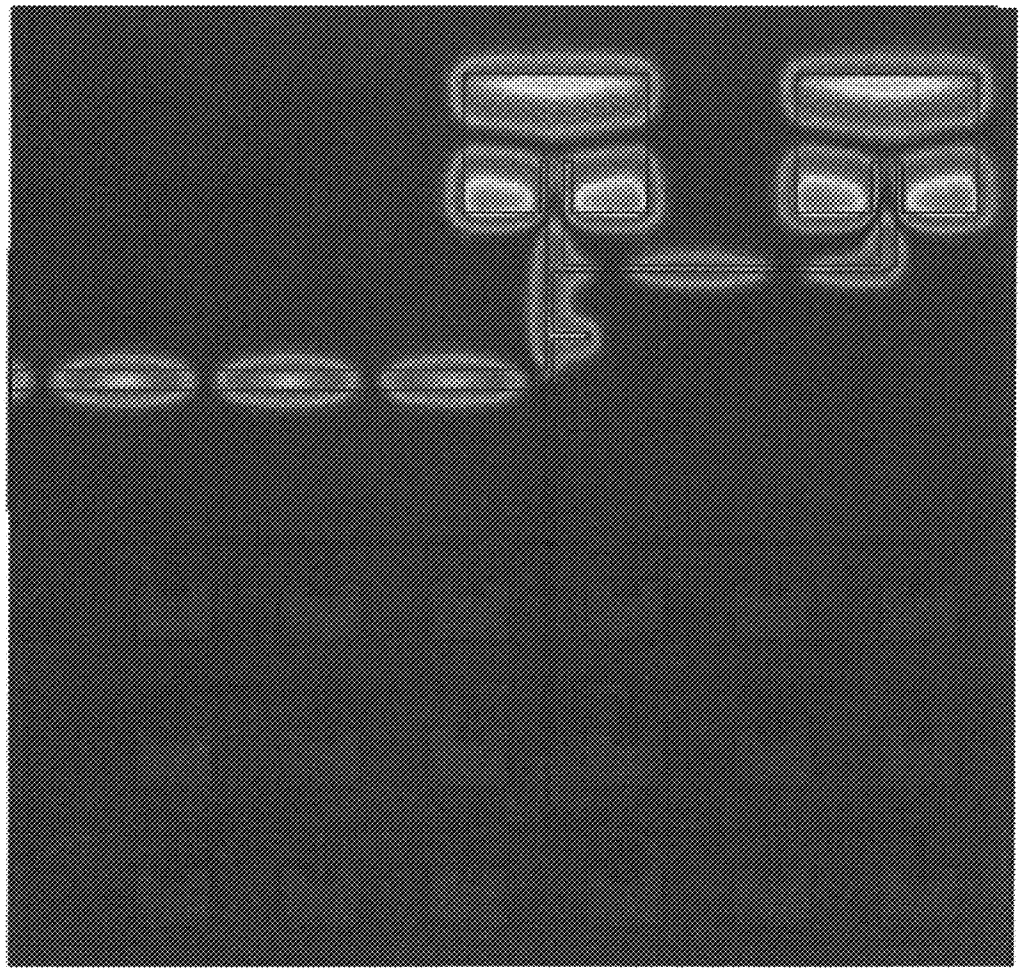
FIGS. 6A to 6D are diagrams illustrating a simulation result when the first band signal is applied to the antenna for the radar detector according to the first embodiment of the present invention.
Figure 6B:
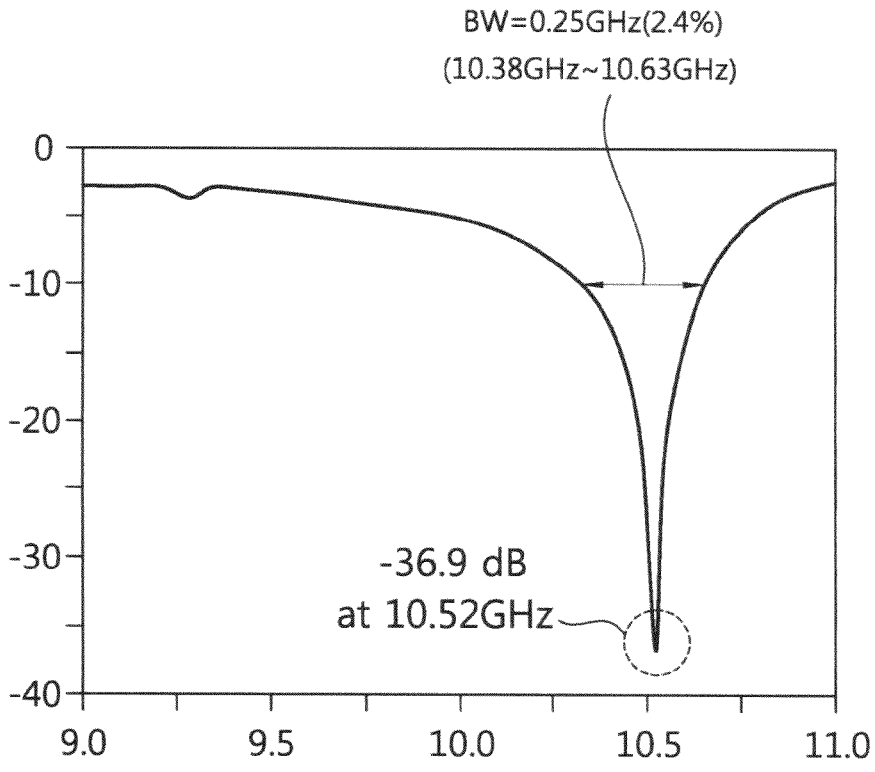
Figure 6C:
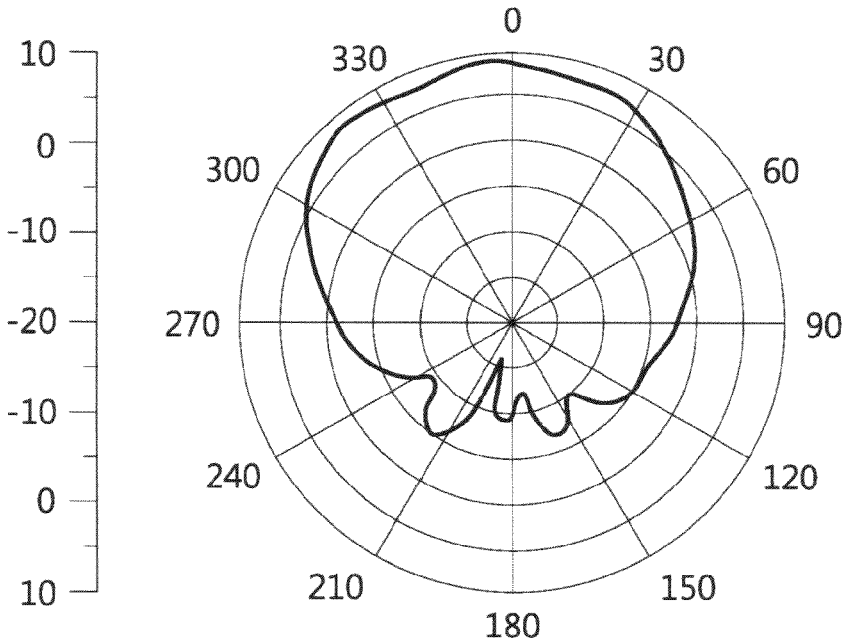
Figure 6D:
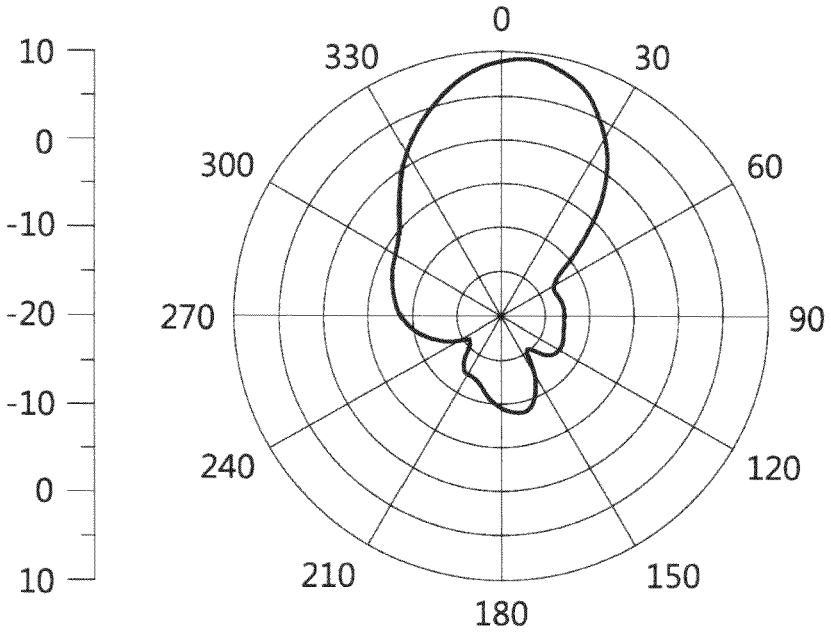

FIGS. 6A to 6D are diagrams illustrating a simulation result when the first band signal is applied to the antenna for the radar detector according to the first embodiment of the present invention, FIG. 6A is a diagram illustrating a field distribution, FIG. 6B is a graph illustrating a reflective loss, FIG. 6C is a graph illustrating an E-Plane radiation pattern, and FIG. 6D is a graph illustrating an H-Plane radiation pattern.

The simulation result illustrated in FIGS. 6A to 6D is a result in which on the condition that the first band patch antenna 110 is designed as an X band patch antenna and the second band patch antenna 120 is designed as a K band patch antenna, a signal of 10.525 GHz which is the X band is applied to the power supply unit 101.

As illustrated in FIG. 6A, the first band signal of 10.525 GHz applied to the power supply unit 101 progresses to the first band patch antenna 110 by the second band stub 140, but is prevented from progressing to the second band patch antenna 120 by the first band stub 130.

As a measuring result, the impedance of the first band stub 130 is measured as about 6,000Ω with respect to the signal of 10.525 GHz, and as a result, the signal applied to the power supply unit 101 is prevented from progressing to the second band patch antenna 120.

As illustrated in FIGS. 6B to 6D, even though the antenna for the radar detector 100 according to the embodiment includes patch antennas 110 and 120 having two different bands, the applied X band signal of 10.525 GHz is prevented from being applied to the second band patch antenna 120 to have a reflective loss and a radiation pattern which are very similar to the case where only the X band patch antenna 110 exists.

Figure 7A:
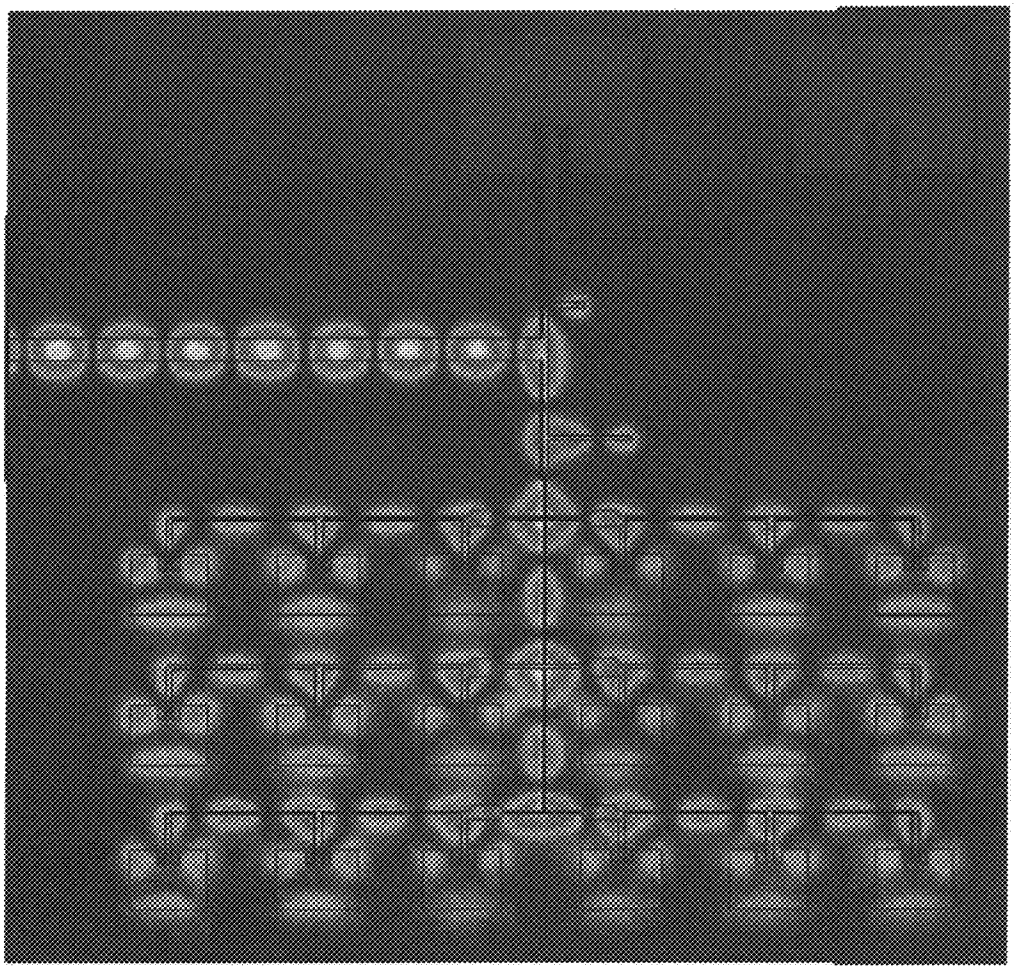
FIGS. 7A to 7D are diagrams illustrating a simulation result when the second band signal is applied to the antenna for the radar detector according to the first embodiment of the present invention.
Figure 7B:
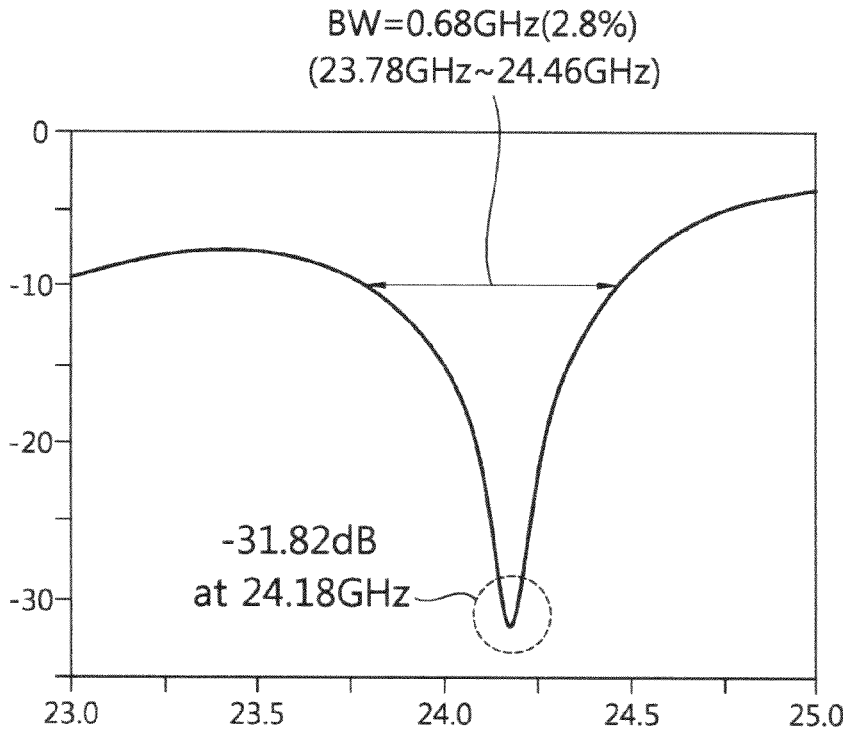
Figure 7C:
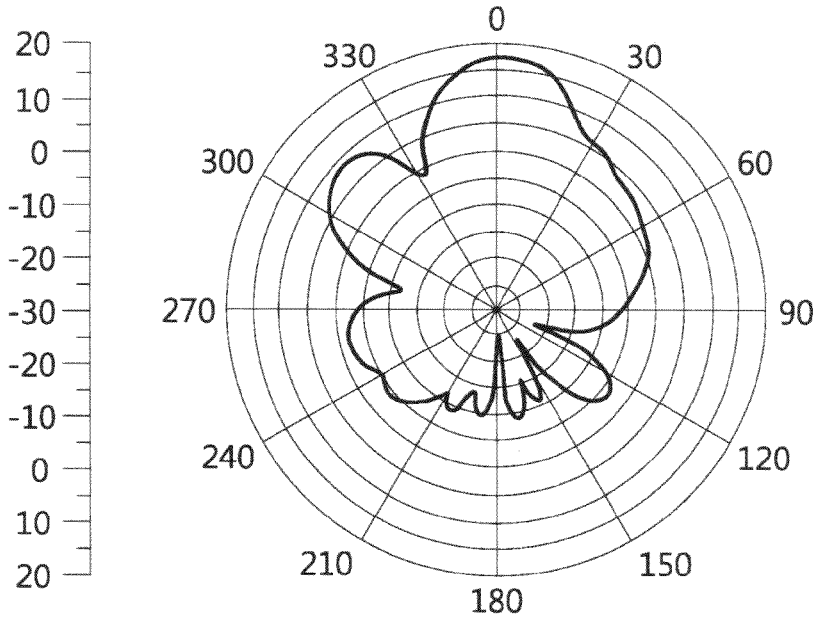
Figure 7D:
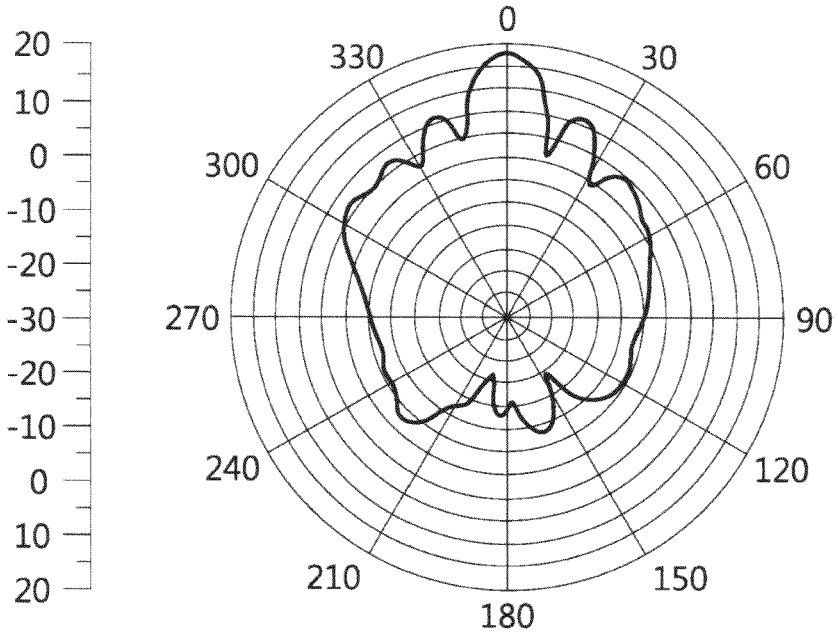

FIGS. 7A to 7D are diagrams illustrating a simulation result when the second band signal is applied to the antenna for the radar detector according to the first embodiment of the present invention, FIG. 7A is a diagram illustrating a field distribution, FIG. 7B is a graph illustrating a reflective loss, FIG. 7C is a graph illustrating an E-Plane radiation pattern, and FIG. 7D is a graph illustrating an H-Plane radiation pattern.

The simulation result illustrated in FIGS. 7A to 7D is a result in which on the condition that the first band patch antenna 110 is designed as an X band patch antenna and the second band patch antenna 120 is designed as a K band patch antenna, a signal of 24.15 GHz which is the K band is applied to the power supply unit 101.

As illustrated in FIG. 7A, the second band signal of 24.15 GHz applied to the power supply unit 101 progresses to the second band patch antenna 120 by the first band stub 130, but is prevented from progressing to the first band patch antenna 110 by the second band stub 140.

As a measuring result, the impedance of the second band stub 140 is measured as about 3000Ω with respect to the signal of 24.15 GHz, and as a result, the signal applied to the power supply unit 101 is prevented from progressing to the first band patch antenna 110.

As illustrated in FIGS. 7B to 7D, even though the antenna for the radar detector 100 according to the embodiment includes patch antennas 110,120 and 120 having two different bands, the applied K band signal of 24.15 GHz is prevented from being applied to the first band patch antenna 110 to have a reflective loss and a radiation pattern which are very similar to the case where only the K band patch antenna 120 exists.

By the above configuration, since the each of the patch antennas 110 and 120 may selectively operate according to the frequency band of the applied signal, the antennas of the radar detector may match one power supply unit without damaging the properties of a plurality of antennas that have different frequency properties, and as a result, one radar detector may correspond to various kinds of speed guns using different frequency bands, and a circuit configuration may be simplified.

Hereinafter, an antenna for a radar detector according to a second embodiment of the present invention will be described. For convenience of the description, similar parts to the first embodiment use the same reference numerals, and the description of common parts with the first embodiment is omitted.

Figure 8:
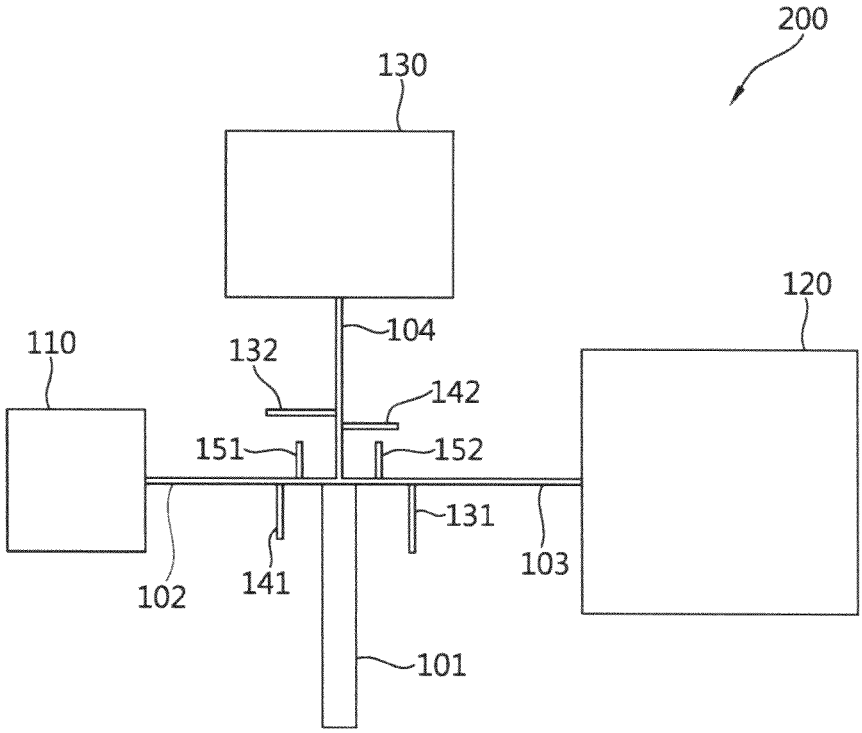
FIG. 8 is a plan view illustrating an antenna for a radar detector according to a second embodiment of the present invention.

FIG. 8 is a plan view illustrating an antenna for a radar detector according to a second embodiment of the present invention.

As illustrated in FIG. 8, an antenna for a radar detector 200 according to the second embodiment of the present invention may further include a third band patch antenna 130 which may selectively operate with respect to three band areas.

The antenna for the radar detector 200 according to the second embodiment of the present invention includes a power supply unit 101, a first branch 102, a second branch 103, and a third branch 104 branched from the power supply unit 101, a first band patch antenna 110 connected to the first branch 102, a second band patch antenna 120 connected to the second branch 103, and a third band patch antenna 130 connected to the third branch 103, a second band first stub 141 and a third band first stub 151 disposed on the first branch, a first band first stub 131 and a third band second stub 152 disposed on the second branch, and a first band second stub 132 and a second band second stub 142 disposed on the third branch.

The first band patch antenna 110 is connected to an end of the first branch 102.

Further, on the first branch 102, the second band first stub 141 may be provided at a position spaced apart from the power supply unit 101 by ¼ length of a guided wavelength $\lambda g_2$ of a second band central frequency in which the second band patch antennas 120 operates, and the third band first stub 151 may be provided at a position spaced apart from the power supply unit 101 by ¼ length of a guided wavelength $\lambda g_3$ of a third band central frequency in which the third band patch antennas 130 operates.

The second band first stub 141 may be substantially vertically protrude from the first branch 102 by the ¼ length of the guided wavelength $\lambda g_2$ of the second band central frequency, and the third band first stub 151 may be substantially vertically protrude from the first branch 102 by the ¼ length of the guided wavelength $\lambda g_3$ of the third band central frequency.

The second band first stub 141 and the third band first stub 151 may protrude from the first branch 102 in opposite directions in order to minimize interaction.

Meanwhile, the second band patch antenna 120 is connected to an end of the second branch 103.

Further, on the second branch 103, the first band first stub 131 may be provided at a position spaced apart from the power supply unit 101 by ¼ length of a guided wavelength $\lambda g_1$ of the first band central frequency in which the first band patch antennas 110 operates, and the third band second stub 152 may be provided at a position spaced apart from the power supply unit 101 by ¼ length of the guided wavelength $\lambda g_3$ of the third band central frequency in which the third band patch antennas 130 operates.

The first band first stub 131 may be substantially vertically protrude from the second branch 103 by the ¼ length of the guided wavelength $\lambda g_1$ of the first band central frequency, and the third band second stub 152 may be substantially vertically protrude from the second branch 103 by the ¼ length of the guided wavelength $\lambda g_3$ of the third band central frequency.

The first band first stub 131 and the third band second stub 152 may protrude from the second branch 103 in opposite directions in order to minimize interaction.

Meanwhile, the third band patch antenna 130 is connected to an end of the third branch 104.

Further, on the third branch 104, the first band second stub 132 may be provided at a position spaced apart from the power supply unit 101 by the ¼ length of the guided wavelength $\lambda g_1$ of the first band central frequency, and the second band second stub 142 may be provided at a position spaced apart from the power supply unit 101 by the ¼ length of the guided wavelength $\lambda g_2$ of the second band central frequency.

The first band second stub 132 may be substantially vertically protrude from the third branch 104 by the ¼ length of the guided wavelength $\lambda g_1$ of the first band central frequency, and the second band second stub 142 may be substantially vertically protrude from the second branch 103 by the ¼ length of the guided wavelength $\lambda g_2$ of the third band central frequency.

The first band second stub 132 and the second band second stub 142 may protrude from the third branch 104 in opposite directions in order to minimize interaction.

In addition, the input impedances viewing the patch antennas 110, 120, and 130 from the power supply unit may be designed to be the same as each other, and the input impedances may be designed to be 50Ω.

The first band patch antenna 110, the second band patch antenna 120, and the third band patch antenna 130 may be designed as a patch antenna which operates at any one of an X band of 8 GHz to 12 GHz, a Ku band of 10.95 GHz to 14.5 GHz, a K band of 18 GHz to 27 GHz and a Ka band of 26.5 GHz to 40 GHz. However, the first band patch antenna 110, the second band patch antenna 120, and the third band patch antenna 130 may select different frequency bands.

By the above configuration, when the first band signal in which the first band patch antenna 110 operates is applied to the power supply unit 101, the first band first stub 131 provided on the second stub 103 prevents the corresponding signal from being applied to the second band patch antenna 120, and the first band second stub 132 provided on the third branch may prevent the corresponding signal from being applied to the third band patch antenna 130.

In addition, the second band first stub 141 and the third band first stub 151 provided on the first branch 102 apply the corresponding signal to the first band patch antenna 110, and as a result, only the first band patch antenna 110 may operate with respect to the first band signal.

Meanwhile, when the second band signal in which the second band patch antenna 120 operates is applied to the power supply unit 101, the second band first stub 141 provided on the first stub 102 prevents the corresponding signal from being applied to the first band patch antenna 110, and the second band second stub 142 provided on the third branch may prevent the corresponding signal from being applied to the third band patch antenna 130.

In addition, the first band first stub 131 and the third band second stub 152 provided on the second branch 103 apply the corresponding signal to the second band patch antenna 120, and as a result, only the second band patch antenna 120 may operate with respect to the second band signal.

Meanwhile, when the third band signal in which the third band patch antenna 130 operates is applied to the power supply unit 101, the third band first stub 151 provided on the first stub 102 prevents the corresponding signal from being applied to the first band patch antenna 110, and the third band second stub 152 provided on the second branch may prevent the corresponding signal from being applied to the second band patch antenna 120.

In addition, the first band second stub 132 and the second band second stub 142 provided on the third branch 104 apply the corresponding signal to the third band patch antenna 130, and as a result, only the third band patch antenna 130 may operate with respect to the third band signal.

As an extension of the above configuration, three or more patch antennas are provided to configure the antenna for the radar detector that selectively operates with respect to three or more frequency bands, and this may also belong to the scope of the present invention.

Hereinafter, an antenna for a radar detector according to a third embodiment of the present invention will be described. For convenience of the description, similar parts to the first embodiment use the same reference numerals, and the description of common parts with the first embodiment is omitted.

Figure 9:
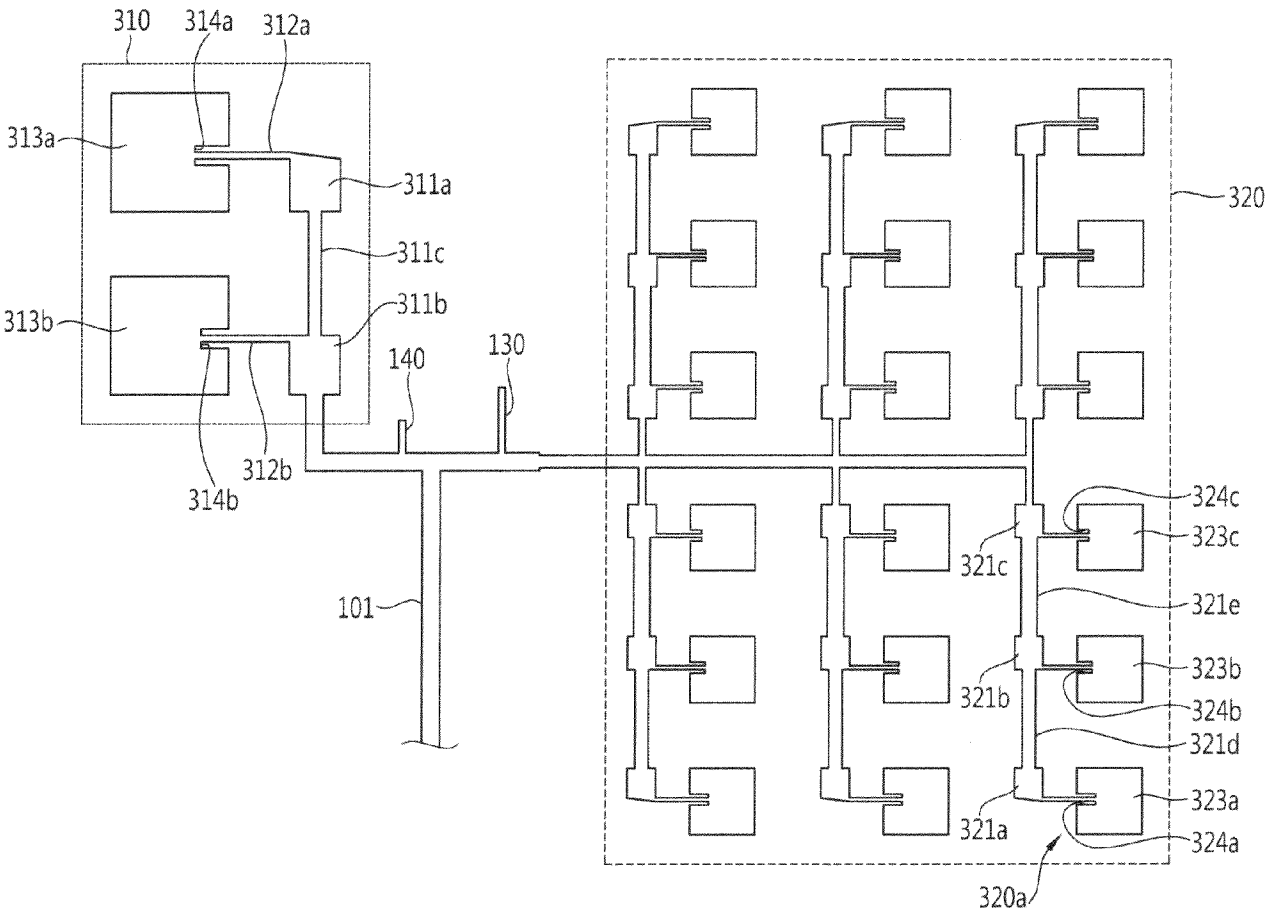
FIG. 9 is a plan view illustrating an antenna for a radar detector according to a third embodiment of the present invention.

FIG. 9 is a plan view illustrating an antenna for a radar detector according to a third embodiment of the present invention.

When comparing an antenna for a radar detector 300 according to a third embodiment of the present invention with the antenna for the radar detector 100 according to the first embodiment, a first band patch antenna 310 and a second band patch antenna 320 include a plurality of radiation patches 313*a*, 313*b*, 323*a*, 323*b*, and 323*c* with insets 314*a*, 314*b*, 324*a*, 324*b*, and 324*c* having difference lengths.

As illustrated in FIG. 9, the first band patch antenna 310 of the antenna for the radar detector 300 according to the third embodiment of the present invention may include a first band first radiation patch 313*a* and a first band second radiation patch 313*b* having different lengths of the insets 314*a* and 314*b*.

Further, the second band patch antenna 320 may include at least one radiation module 320*a* including a second band first radiation patch 323*a*, a second band second radiation patch 323*b*, and a second band third radiation patch 323*c* having different lengths of the insets 324*a*, 324*b*, and 324*c*.

Figure 10:
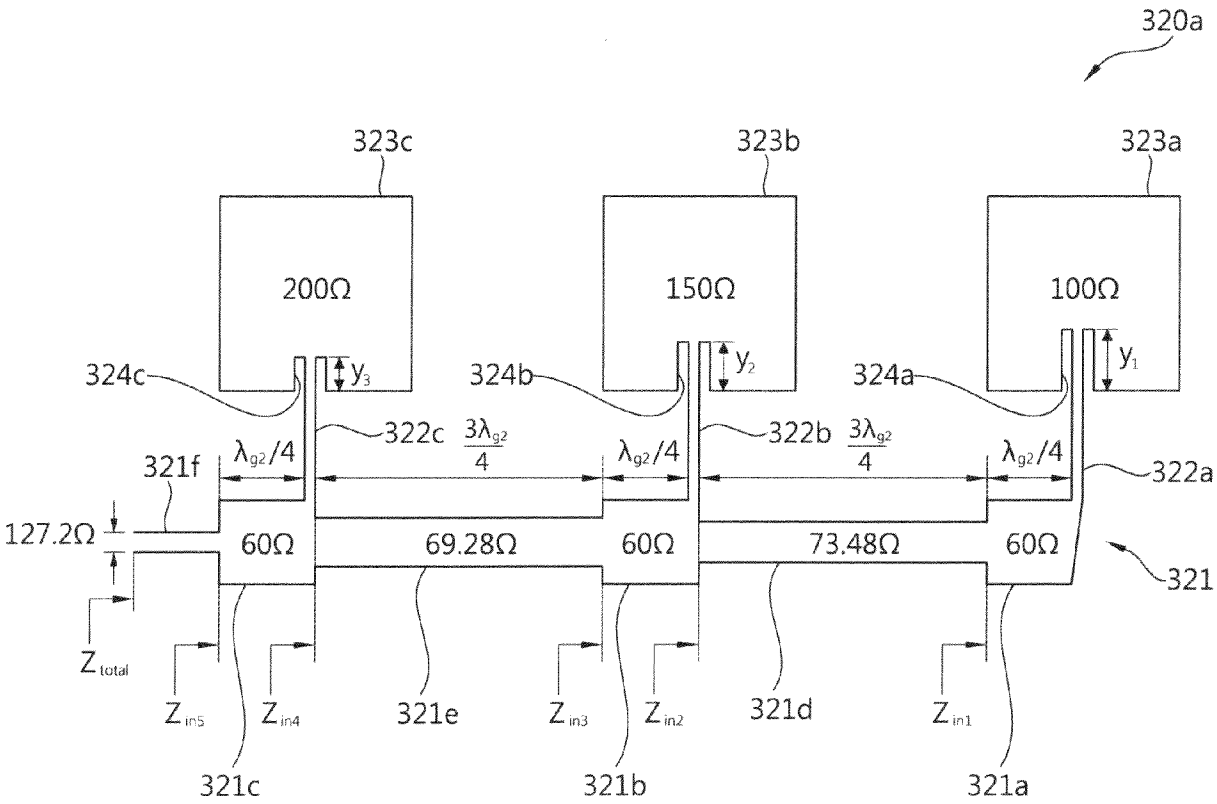
FIG. 10 is a diagram illustrating one radiation module of a second band patch antenna of the antenna for the radar detector according to the third embodiment of the present invention.

FIG. 10 is a diagram illustrating one radiation module of a second band patch antenna of the antenna for the radar detector according to the third embodiment of the present invention.

As illustrated in FIG. 10, the radiation module 320*a* according to the embodiment may be an unequal impedance radiation module in which a radiation patch with a 1×3 array is arranged. Further, if necessary, the radiation module may have another array shape.

The embodiment is a K band antenna, and three radiation patches 323*a*, 323*b*, and 323*c* are designed to have a width of 4.4 mm and a length of 3.6 mm, and lengths y1, y2, and y3 of the insets 324*a*, 324*b*, and 324*c* are designed as 1.4 mm, 1.1 mm, and 0.6 mm, respectively. In addition, a width of the insets 324*a*, 324*b*, and 324*c* is designed as 0.1 mm.

Hereinafter, the radiation patch of which the length y1 of the inset 324*a* is 1.4 mm is referred to as the second band first radiation patch 323*a*, the radiation patch of which the length y2 of the inset 324*b* is 1.1 mm is referred to as the second band second radiation patch 323*b*, and the radiation patch of which the length y3 of the inset 324*c* is 0.6 mm is referred to as the second band third radiation patch 323*c*.

According to the design, an impedance of the second band first radiation patch 323*a* may be 100Ω, an impedance of the second band second radiation patch 323*b* may be 150Ω, and an impedance of the second band third radiation patch 323*c* may be 200Ω.

The three radiation patches 323*a*, 323*b*, and 323*c* may be connected to the second band strip 321 in parallel through the second band power supply lines 322*a*, 322*b*, and 322*c*.

Similarly to the first embodiment of the present invention, in order to set a phase difference between the radiation patches 323*a*, 323*b*, and 323*c* as zero, the adjacent second band power supply lines 322*a*, 322*b*, and 322*c* may be positioned so that an interval therebetween becomes a positive integer multiple of the guided wavelength $\lambda g_2$ of the second band central frequency.

Meanwhile, the second band strip 321 may include a plurality of matching terminals 321*a*, 321*b*, and 321*c* corresponding to each of the radiation patches 323*a*, 323*b*, and 323*c*, and connection strips 321*d*, 321*e*, and 321*f* electrically connecting the matching terminals 321*a*, 321*b*, and 321*c*.

The matching terminals 321*a*, 321*b*, and 321*c* are placed at a portion where the second band power supply lines 322*a*, 322*b*, and 322*c* are connected with the second band strip 321, and apply the same current to each of the radiation patches 323*a*, 323*b*, and 323*c* having different impedances.

As illustrated in FIG. 10, when the interval between the second band power supply lines 322*a*, 322*b*, and 322*c* is designed to be equal to the guided wavelength $\lambda g_2$, lengths of the first connection strip 321*d* and the second connection strip 321*e* connecting the adjacent matching terminals 321*a*, 321*b*, and 321*c* may be provided to be ¾ of each guided wavelength $\lambda g_2$, and the lengths of the matching terminals 321*a*, 321*b*, and 321*c* may be formed to be ¼ of each guided wavelength $\lambda g_2$.

An input impedance $Z_{in}$ in the second band strip 321 may be calculated by the following Equation 5.

$$Z_{in} = Z_0 \frac{Z_L + jZ_0 \tan \beta\ell}{Z_0 + jZ_L \tan \beta\ell} \quad \text{[Equation 5]}$$

β is $$\beta = \frac{2\pi}{\lambda g_2}$$

as a propagation constant, l is a length of the second band strip 321, $Z_0$ is a characteristic impedance of the second band strip 321, and $Z_L$ is an impedance of a power supply element.

In the case of $Z_{in1}$, since the length l of the second band strip 321 is $$\frac{\lambda g_2}{4}$$

as the length of the matching terminal 321*a*, the length l is substituted by Equation 5 as follows.

$$Z_{in1} = Z_0 \frac{Z_L + jZ_0 \tan \frac{\pi}{2}}{Z_0 + jZ_L \tan \frac{\pi}{2}} \approx Z_0 \frac{jZ_0 \tan \frac{\pi}{2}}{jZ_L \tan \frac{\pi}{2}} = \frac{Z_0^2}{Z_L} = \frac{60^2}{100} = 36\Omega$$

In the case of $Z_{in2}$, since the length l of the second band strip 321 is $$\frac{3\lambda g_2}{4}$$

as the length of the first connection strip 321*d*, the length l is substituted by Equation 5 as follows.

$$Z_{in2} = Z_0 \frac{Z_L + jZ_0 \tan \frac{3\pi}{2}}{Z_0 + jZ_L \tan \frac{3\pi}{2}} \approx Z_0 \frac{jZ_0 \tan \frac{3\pi}{2}}{jZ_L \tan \frac{3\pi}{2}} = \frac{Z_0^2}{Z_L} = \frac{73.48^2}{36} \approx 150\Omega$$

Since the calculated input impedance $Z_{in2}$ and the impedance of the second band second radiation patch 323*b* are the same as each other as 150Ω, finally, the same current may be applied to the second band first radiation patch 323*a* and the second band second radiation patch 323*b*.

In the same manner as described above, $$Z_{in3} = \frac{60^2}{76} = 48\Omega \text{ and } Z_{in4} = \frac{69.28^2}{48} = 100\Omega.$$

Since a ratio of the calculated input impedance $Z_{in4}$ and the impedance of the second band third radiation patch 323*c* is 1:2, a ratio of a current flowing in the second connection strip 321*e* and a current flowing in the second band third radiation patch 323*c* is 2:1.

In addition, since the currents flowing in the second band first radiation patch 323*a* and the second band second radiation patch 323*b* are the same as each other, finally, the same current is applied to the second band first radiation patch 323*a*, the second band second radiation patch 323*b*, and the second band third radiation patch 323*c*.

Further, $$Z_{in5} = \frac{60^2}{66.67} = 54\Omega, \quad Z_{total} = \frac{127.2^2}{54} = 300\Omega.$$

Through the above design, even though the radiation patches having different impedances are used, the current may be equally provided. This may prevent unexpected results when the patch antennas are designed to improve ease of the design of the antennas.

Unlike the embodiment, even in the case where the interval between the adjacent second band power supply lines 322*a*, 322*b*, and 322*c* is an integer multiple of the guided wavelength λg, the lengths of the first connection strip 321*d* and the second connection strip 321*e* and the lengths of the matching terminals 321*a*, 321*b*, and 321*c* are designed as the length l of $$\tan\beta\ell = \frac{n\pi}{2}$$

(n is an odd number) so that a value of tan β1 is ±∞ in Equation 5 to thereby obtain the same effect.

The entire size of the second band first radiation patch 323*a*, the second band second radiation patch 323*b*, and the second band third radiation patch 323*c* of the radiation module 320*a* according to the embodiment is the same, but the lengths y1, y2, and y3 of the insets 324*a*, 324*b*, and 324*c* formed in the radiation patches 323*a*, 323*b*, and 323*c* are different from each other, and as a result, resonant frequencies of the radiation patches 323*a*, 323*b*, and 323*c* are different from each other. As a result, the radiation module 320*a* according to the embodiment has a larger bandwidth due to a triple resonance effect.

In addition, as illustrated in FIG. 9, a plurality of radiation modules 320*a* according to the embodiment is included to improve a gain of the antenna.

Figure 11:
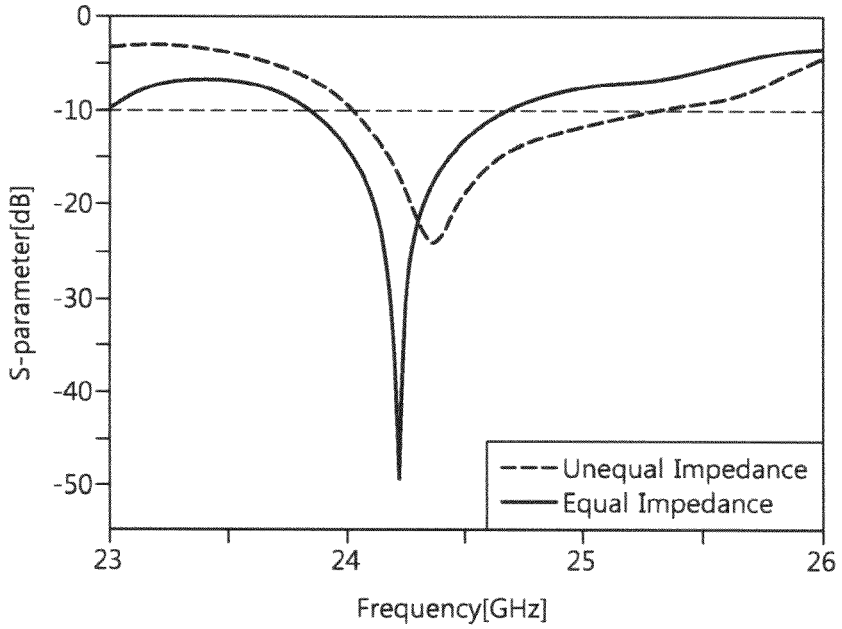
FIG. 11 is a graph comparing bandwidths of a second band patch antenna and an equal impedance patch antenna according to the third embodiment of the present invention.

FIG. 11 is a graph comparing bandwidths of a second band patch antenna and an equal impedance patch antenna according to the third embodiment of the present invention.

The second band patch antenna 320 according to the third embodiment of the present invention includes six radiation modules 320*a* in a symmetrical shape to configure a 3×6 unequal array antenna, and a TLY-5 substrate of which a dielectric constant $\in_r$ is 2.2 is used.

A 3×6 equal impedance array antenna which is a comparison target also uses the same array shape and the same TLY-5 substrate.

However, the 3×6 equal impedance array antenna uses a radiation patch having the same impedance of 200Ω as the second band third radiation patch 323*c* of the radiation module 320*a* according to the embodiment as the radiation patch.

As an experimental result, as illustrated in FIG. 6, 10 dB bandwidths of the second band patch antenna 320 according to the third embodiment of the present invention and the 3×6 equal impedance array antenna are measured as 1.2 GHz (24.03 GHz to 25.03 GHz, 4.93%) and 830 MHz (23.84 GH to 24.67 GHz, 3.43%), respectively.

Through the above experimental result, it can be seen that the 10 dB bandwidth of the second band patch antenna 320 according to the third embodiment of the present invention is about 1.5 times larger than that of the 3×6 equal impedance array antenna.

The embodiment corresponds to one example for designing the second band patch antenna 320 as a K band antenna, but the present invention is not limited thereto, and in order to design an antenna for another frequency area desired by a designer, a size and a shape may vary. Particularly, since a width W and an inset length $y_0$ are known as factors that determine the impedance, a length L is known as a factor that determines a resonant frequency of the antenna, antennas for the X band, the Ku band, the Ka band, and the like other than the K band may be manufactured by controlling the factors, and the patch array antenna by the above configuration may be sued in the radar detector, and may be applied even to other applications in which the patch antenna is used. Further, the number of radiation patches and the array structure may be variously modified.

The first band patch antenna 310 may also include a plurality of radiation patches 313*a* and 313*b* with insets 314*a* and 314*b* having different lengths, similarly to the aforementioned second band patch antenna 320, and matching terminals 311*a* and 311*b* may be included in the first band strip 311 so that the same current is applied to each of the radiation patches 313*a* and 313*b*.

The first band strip 311 including the matching terminals 311*a* and 311*b* and the connection strips 311*c* and 311*d* may be designed by using the aforementioned Equation 5. Since the detailed contents therefor are described in the second band patch antenna 320, the detailed contents are omitted.

Meanwhile, in the aforementioned embodiment, the unequal patch antenna is implemented through the plurality of radiation patches 313*a*, 313*b*, 323*a*, 323*b*, and 323*c* with the insets having different lengths, but the unequal patch antenna may be implemented by varying shapes of the radiation patches 313*a*, 313*b*, 323*a*, 323*b*, and 323*c*, varying widths of the first band power supply lines 312*a* and 312*b*, and varying widths of the second band power supply lines 322*a*, 322*b*, and 322*c*.

Hereinafter, an antenna for a radar detector according to a fourth embodiment of the present invention will be described. For convenience of the description, similar parts to the first embodiment use the same reference numerals, and the description of common parts with the first embodiment is omitted.

Figure 12A:
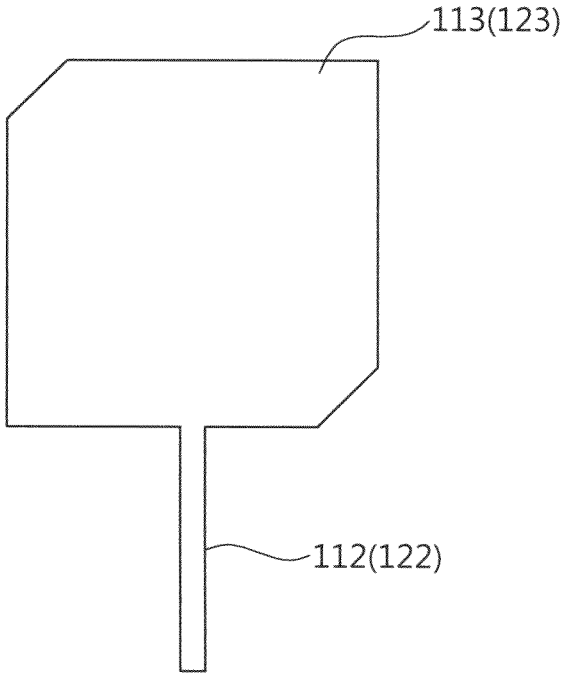
FIGS. 12A to 12C are plan views illustrating a radiation patch of an antenna for a radar detector according to a fourth embodiment of the present invention.
Figure 12B:
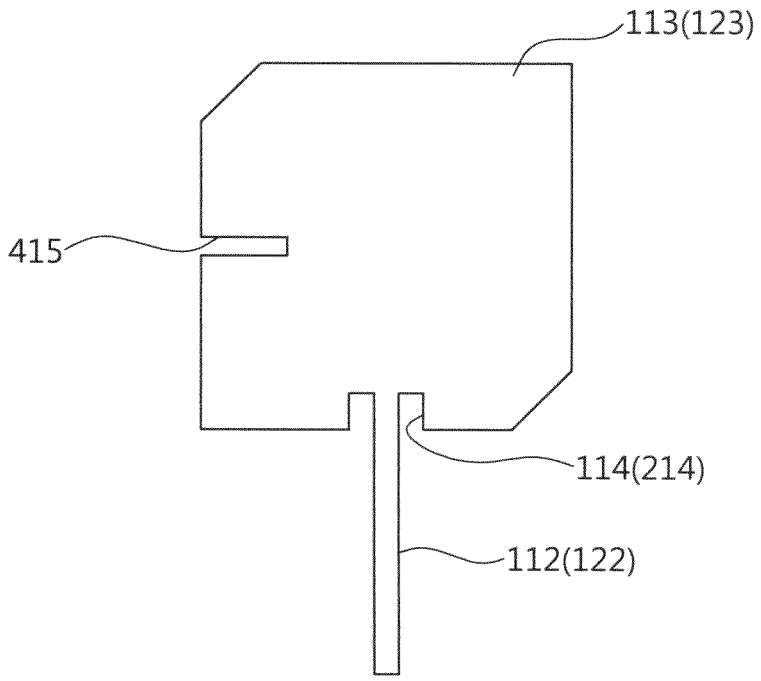
Figure 12C:
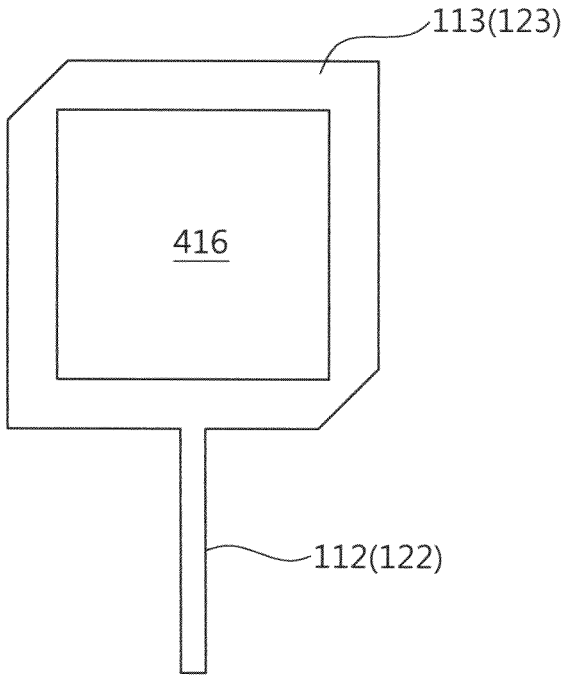

FIGS. 12A to 12C are plan views illustrating a radiation patch of an antenna for a radar detector according to a fourth embodiment of the present invention.

As illustrated in FIGS. 12A to 12C, a first radiation patch 113 and/or a second radiation patch 123 of the antenna for the radar detector according to the fourth embodiment of the present invention may be configured by a circularly polarized patch.

The circularly polarized patch is a patch receiving a circularly polarized wave which progresses in a spiral trace while rotating on a vibration plane.

The antenna for the radar detector according to the fourth embodiment of the present invention may detect a transmitting signal by using the circularly polarized patch as the first radiation patch 113 and/or the second radiation patch 123 regardless of a polarized direction of the transmitting signal which is a signal emitted from a speed gun and the like, and detect the transmitting signal even in the case where the transmitting signal is reflected by a road, a building, or the like and thus a polarized direction is distorted.

Hereinafter, several example of the circularly polarized patch will be described. Those skilled in the art can modify and change the technical spirit of the present invention in various forms. Accordingly the scope of the present invention is not limited thereto.

FIG. 12A illustrates one example of the circularly polarized patch according to the fourth embodiment of the present invention, and circularly polarized patches 113 and 123 which are formed in a hexagonal shape in which apexes in a diagonal direction are cut in parallel in a quadrangular patch may be used. Similarly to the first embodiment of the present invention, the circularly polarized patches 113 and 123 may be connected with the power supply lines 112 and 122.

FIG. 12B illustrates another example of the circularly polarized patch according to the fourth embodiment of the present invention, which has a shape in which an inset cut 415 capable of controlling an input resistance of the patch is further formed at one side of the hexagonal patch illustrated in FIG. 12A. A plurality of inset cuts 415 may be formed.

Further, insets 114 and 124 recessed to the insides of the circularly polarized patches 113 and 123 may be provided at both sides of the power supply lines 112 and 122.

FIG. 12C illustrates yet another example of the circularly polarized patch according to the fourth embodiment of the present invention, which is circularly polarized patches 113 and 123 having a shape similar to a quadrangular ring by forming a quadrangular hole 416 at the center of the hexagonal patch illustrated in FIG. 12A.

In the case of the circularly polarized patch illustrated in FIG. 12C, the size of the patch may be minimized, and thus the radar detector may be downsized.

It should not be analyzed that the exemplary embodiments of the present invention, which are described above and illustrated in the drawings limit the technical spirit of the present invention. The protection scope of the present invention is limited by only matters described in the appended claims and various modifications and changes of the technical spirit of the present invention can be made by those skilled in the art. Accordingly, the modifications and changes will be included in the protection scope of the present invention if the modifications and changes are apparent to those skilled in the art.

EXPLANATION OF REFERENCE NUMERALS AND SYMBOLS

100, 200, 300: Antenna for radar detector
101: Power supply unit 102: First branch
103: Second branch 104: Third branch
110, 310: First band patch antenna 111, 311: First band strip
112, 312*a*, 312*b*: First band power supply line 113, 313*a*, 313*b*: First radiation patch
114, 124, 314*a*, 314*b*, 324*a*, 324*b*, 324*c*: Inset
120, 320: Second band patch antenna 121, 321: Second band strip
122, 322*a*, 322*b*, 322*c*: Second band power supply line
123, 323*a*, 323*b*, 323*c*: Second radiation patch 130: First band stub
131: First band first stub 132: First band second stub
140: Second band stub 141: Second band first stub
142: Second band second stub 151: Third band first stub
152: Third band second stub
311*a*, 311*b*, 321*a*, 321*b*, 321*c*: Matching terminal
311*c*, 311*d*, 321*d*, 321*e*, 321*f*: Connection strip
415: Inset cut 416: Quadrangular hole

The invention claimed is:

1. An antenna for a radar detector, comprising:
- a power supply unit; a first branch and a second branched from the power supply unit;
- a first band patch antenna connected to the first branch and having a first band property;
- a second band patch antenna connected to the second branch and having a second band property;
- a second band stub placed between the power supply unit and the first band patch antenna on the first branch to prevent a signal of the second band from progressing to the first band patch antenna; and
- a first band stub placed between the power supply unit and the second band patch antenna on the second branch to prevent a signal of the first band from progressing to the second band patch antenna,
- wherein the first band stub is positioned to be spaced apart from the power supply unit by a length of ¼ of a guided wavelength of the first band, and the second stub is positioned to be spaced apart from the power supply unit by a length of ¼ of a guided wavelength of the second band,
- wherein the length of the first band stub corresponds to the ¼ length of the guided wavelength of the first band, and the length of the second band stub corresponds to the ¼ length of the guided wavelength of the second band.

2. The antenna for the radar detector of claim 1, wherein the power supply unit, and the first branch and the second branch form a T type junction.

3. The antenna for the radar detector of claim 1, wherein the first band is included in any one band of an X band of 8 GHz to 12 GHz, a Ku band of 10.95 GHz to 14.5 GHz, a K band of 18 GHz to 27 GHz, a Ka band of 26.5 GHz to 40 GHz.

4. The antenna for the radar detector of claim 3, wherein the second band is included in any one band other than the band in which the first band is included, among the X band of 8 GHz to 12 GHz, the Ku band of 10.95 GHz to 14.5 GHz, the K band of 18 GHz to 27 GHz, the Ka band of 26.5 GHz to 40 GHz.

5. The antenna for the radar detector of claim 1, wherein a first input impedance of the power supply unit for the first band patch antenna including the second band stub is the same as a second input impedance of the power supply unit for the second band patch antenna including the first band stub.

6. The antenna for the radar detector of claim 5, wherein the first input impedance and the second input impedance are 50Ω.

7. The antenna for the radar detector of claim 1, wherein at least one of the first band patch antenna and the second band patch antenna includes at least one radiation module including:
- a plurality of radiation patches;
- a strip electrically connecting the plurality of radiation patches in parallel; and
- a power supply line electrically connecting the radiation patch and the strip.

8. The antenna for the radar detector of claim 7, wherein impedances of the plurality of radiation patches including the power supply line are different from each other.

9. The antenna for the radar detector of claim 8, wherein in the plurality of radiation patches, insets having different lengths are formed.

10. The antenna for the radar detector of claim 8, wherein the strip includes: a plurality of matching terminals corresponding to the plurality of radiation patches so that the same current is applied to the plurality of radiation patches; and a connection strip connecting adjacent matching terminals with each other.

11. The antenna for the radar detector of claim 10, wherein a sum of lengths of the connection strip and the matching terminal is a positive integer multiple of the guided wavelength.

12. The antenna for the radar detector of claim 11, wherein the length of the connection strip is ¾ of the guided wavelength, and the length of the matching terminal is ¼ of the guided wavelength.

13. The antenna for the radar detector of claim 7, wherein at least some of the plurality of radiation patches are circularly polarized wave patches.

14. The antenna for the radar detector of claim 13, wherein the circularly polarized wave patch is formed in a hexagonal shape of which apexes in a diagonal direction are cut in parallel at a quadrangular patch.

15. An antenna for a radar detector, comprising: a power supply unit;
- a first branch, a second branch, and a third branch branched from the power supply unit;
- a first band patch antenna connected to the first branch and having a first band property;
- a second band patch antenna connected to the second branch and having a second band property;

a third band patch antenna connected to the third branch and having a third band property;

a second band first stub and a third band first stub placed between the power supply unit and the first band patch antenna on the first branch;

a first band first stub and a third band second stub placed between the power supply unit and the second band patch antenna on the second branch;

and a first band second stub and a second band second stub placed between the power supply unit and the third band patch antenna on the third branch, wherein the first band first stub and the first band second stub are spaced apart from the power supply unit by ¼ length of the guided wavelength of the first band, respectively, the second band first stub and the second band second stub are spaced apart from the power supply unit by ¼ length of the guided wavelength of the second band, respectively, and the third band first stub and the third band second stub are spaced apart from the power supply unit by ¼ length of the guided wavelength of the third band, respectively, wherein the first band first stub protrudes from the second branch by the ¼ length of the guided wavelength of the first band, the first band second stub protrudes from the third branch by the ¼ length of the guided wavelength of the first band, the second band first stub protrudes from the first branch by the¼ length of the guided wavelength of the second band, the second band second stub protrudes from the third branch by the ¼ length of the guided wavelength of the second band, the third band first stub protrudes from the first branch by the ¼ length of the guided wavelength of the third band, and the third band second stub protrudes from the second branch by the ¼ length of the guided wavelength of the third band.

16. The antenna for the radar detector of claim 15, wherein the first band, the second band, and the third band include any one band of an X band of 8 GHz to 12 GHz, a Ku band of 10.95 GHz to 14.5 GHz, a K band of 18 GHz to 27 GHz, a Ka band of 26.5 GHz to 40 GHz, and the first band, the second band, and the third band are different bands.

* * * * *